United States Patent [19]

Stumpp

[11] 4,005,691

[45] Feb. 1, 1977

[54] CONTROL INSTALLATION FOR EXHAUST GAS RECYCLING

[75] Inventor: Gerhard Stumpp, Stuttgart, Germany

[73] Assignee: Robert Bosch G.m.b.H., Stuttgart, Germany

[22] Filed: Mar. 25, 1974

[21] Appl. No.: 454,367

[30] Foreign Application Priority Data

Apr. 14, 1973 Germany ..... 2318917

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 2,722,927 | 11/1955 | Cornelius | 123/119 A |
| 3,805,752 | 4/1974 | Cataldo | 123/119 A X |
| 3,827,414 | 8/1974 | Sarto | 123/119 A |

*Primary Examiner*—Charles J. Myhre
*Assistant Examiner*—Sheldon Richter
*Attorney, Agent, or Firm*—Edwin E. Greigg

[57] ABSTRACT

An improved control installation for internal combustion engines having exhaust gas recycling is described. The installation includes a suction tube, a throttle flap valve mounted within the suction tube, an exhaust gas pipe, an exhaust gas recycling valve and a return line leading from the exhaust gas pipe to the recycling valve and from there back to the suction tube downstream of the throttle flap valve. The improvement comprises a bypass line which extends from the suction tube upstream of the throttle flap valve to the recycling valve and back to the suction tube downstream of the throttle flap valve. The air that passes through the bypass line serves to cool the recycling valve. In addition, the bypass line serves as a conduit for air to the engine during idling operation.

3 Claims, 1 Drawing Figure

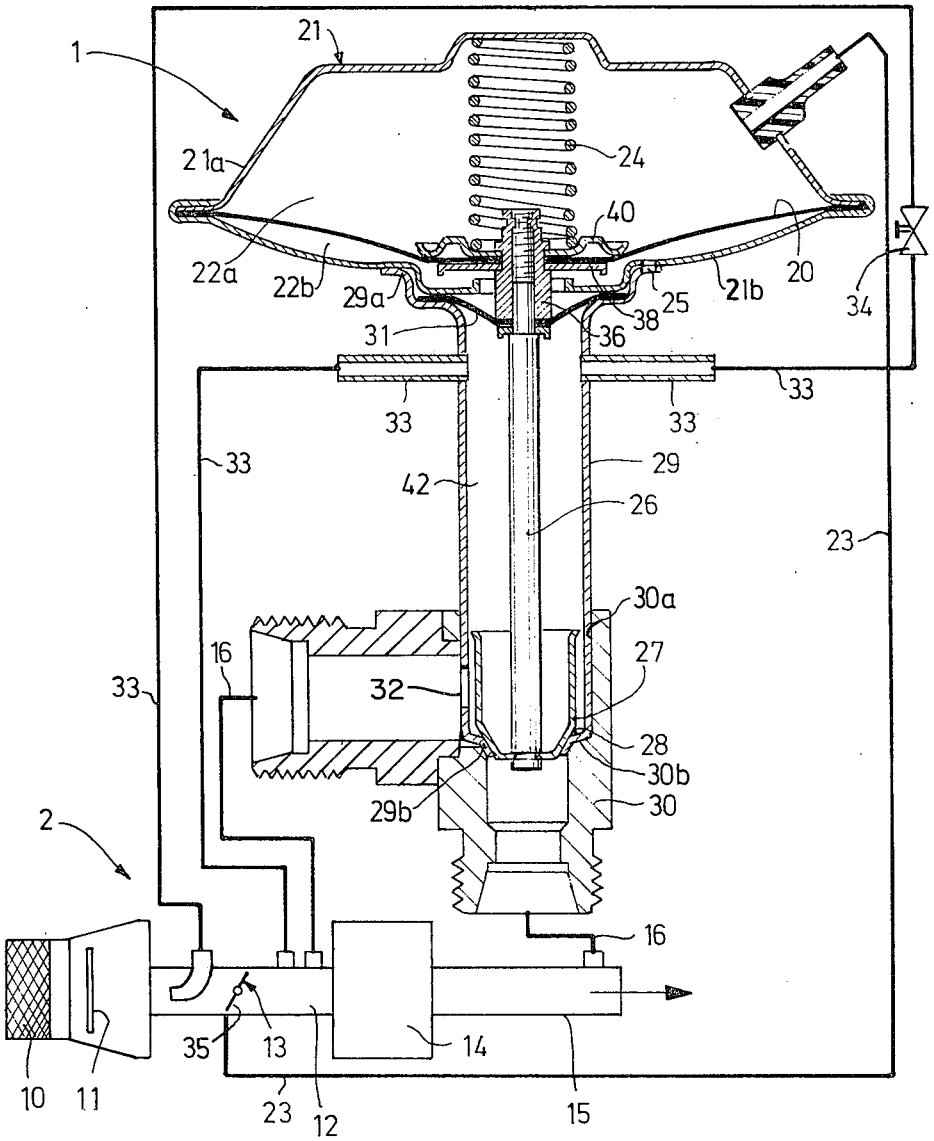
1
21
21a
24
40
22a
22b
29a
25
21b
20
34
31
36
38
33
33
33
33
29
42
26
23
30a
16
27
33
32
28
30b
29b
30
2
16
35
13
14
10
11
23
12
15

CONTROL INSTALLATION FOR EXHAUST GAS RECYCLING

BACKGROUND OF THE INVENTION

The present invention relates to a control installation for use with an internal combustion engine operating with exhaust gas recycling which has an exhaust gas recycling valve disposed in a return line branching off from an exhaust pipe of the engine and terminating in a suction tube thereof downstream of an arbitrarily settable throttle flap valve of the engine which is mounted within the suction tube with the position of the recycling being controlled in dependence on the pressure in the suction tube.

In order to reduce the components in the exhaust gas of an internal combustion engine which are detrimental to health, especially for reducing the components of NOx, a very effective means is the recycling of certain quantities of the exhaust gas. This addition of a gas which does not take part in the combustion process results in a reduction of the combustion temperature, so that less nitric oxide is formed. On the other hand, however, this inert gas reduces the cylinder charge during full-load operation and it deteriorates the smooth running of the engine at low rpm, the effect of which is especially pronounced during idling operation. In order to maintain maximum performance during full-load operation, and in order to guarantee quiet running of the engine during idling operation, exhaust gas recycling should not take place in these domains.

During idling operation, the exhaust gas emission is low because the throughput of gas and the cylinder charge are both small. In addition, the combustion temperatures are lower, and therefore also the emission of nitrogen. In the partial-load domain, however, the nitrogen emission is particularly high and therefore especially dangerous. It is dangerous because in city operation, where the most stringent regulations prevail with respect to exhaust gas emissions, most driving is done in the partial-load domain. Where it is desired, however, during a short term full-load operation, such as may occur for example during the passing of another vehicle, the exhaust gas recycling is not interrupted. In cross-country operation the regulations are less stringent and the maximum performance is required under full load and the accumulation of toxic exhaust gases is lower.

Only during in-town driving which is subject to particularly stringent regulations (CVS-Test) and where the emission is especially great, the exhaust gas is recycled under the ware and short-time full load conditions prevailing there.

This load dependent control occurs with the aid of an exhaust gas recycling valve. This recycling valve must firstly be sealed with respect to the atmosphere in order to prevent the intrusion of leakage air into the suction tube of the engine which could result in rendering the fuel-air mixture unstable. Secondly, it requires high temperatures at its valve seat in order to avoid a deposition of exhaust gas components there. The sealing with respect to the atmosphere is achieved by elastic means which are relatively heat sensitive. It would therefore be desirable to provide means for cooling the area of the recycling valve between the valve seat and the sealing element.

OBJECTS AND SUMMARY OF THE INVENTION

It is, therefore, an object of the present invention to provide the present state of the art with an improved control installation for internal combustion engines having exhaust gas recycling.

It is a more specific object of the present invention to provide means for cooling the recycling valve of the control installation mentioned above.

It is a further object of the present invention to provide means for bypassing the throttle flap valve for supplying air to the engine during idling operation.

It is still a further object of the present invention to provide preferably single means for both the cooling and bypass function.

These and other objects are achieved according to the present invention by the provision of a bypass line which is arranged with one end thereof upstream and the other end thereof downstream of the throttle flap valve in the suction tube of the engine control installation. The bypass line serves as an air supply line during idling operation. In addition, the bypass line passes through the recycling valve and as a result serves to cool the recycling valve.

The exhaust gas recycling valve in particular, includes a membrane against one side of which suction tube pressure is exerted and against the other side of which external air pressure is exerted. The membrane is connected through a valve rod with a movable valve member, which is generally cup shaped. The valve rod and movable valve member are displaceable within a cover tube which in turn is mounted to a valve body and to a housing for the membrane. According to the present invention, the section of the cover tube lying between the movable valve member and the membrane housing can be permeated by the air quantity passing through the bypass line.

Further according to the present invention, a pressure dependent control is achieved by a control line which terminates in the suction tube upstream of the throttle flap valve and in the immediate region of the throttle flap valve member, which in turn moves in opposition to the air stream, and in the recycling valve. As a result, the reduced pressure which prevails at the point of termination during idling operation (closed throttle flap valve member); during partial-load operation (slightly opened throttle flap valve member); and during full-load operation (fully opened throttle flap valve member) is communicated to the recycling valve. During idling operation, the reduced pressure is nearly zero; during partial load, it is a maximum; and during full load, it has an intermediate value. In this way depending on the position of the throttle flap valve, the exhaust gas recycling valve is opened to a greater or lesser extent. In any case however, the closing spring of the valve is chosen so that when the suction tube pressures are too low, i.e., when the air stream in the bypass is too small, the valve remains closed in order to avoid overheating the elastic sealing member of the recycling valve.

BRIEF DESCRIPTION OF THE DRAWING

The sole drawing schematically illustrates the control installation and a cross-sectional view in elevation of the recycling valve and the bypass line arrangement according to the present invention.

DESCRIPTION OF THE PREFERRED EMBODIMENT

The exemplary embodiment consists of an exhaust gas recycling valve 1 of an internal combustion engine installation 2, shown schematically. Within the internal combustion engine installation 2, combustion air is aspirated by an engine 14 through a filter 10 and passes over an air-measuring member 11; and a throttle flap valve 13 mounted in a suction tube 12. The reduced pressure prevailing in the suction tube 12 depends firstly on the rpm of the engine and secondly on the position of the throttle flap valve 13. The combusted gases generated in the engine 14 are led away from the engine 14 through an exhaust pipe 15 which is connected with the suction tube 12 downstream of the throttle flap valve 13. A flow-through or return line 16 is controlled by the exhaust gas recycling valve 1 in dependence on the pressure in the suction tube 12.

The exhaust gas recycling valve 1 includes a membrane housing 21, a cover tube 29, to which the housing 21 is mounted and a valve body 30, to which the cover tube 29 is mounted. The housing 21 includes an upper housing **21*a* and a lower housing 21*b*, which together mount a membrane 20 in a conventional manner. The cover tube 29 includes an opening 32 to provide a continuation of the return line 16**.

The membrane 20, together with the upper membrane housing **21*a*, defines a chamber 22*a* (first chamber) within which a reduced pressure exists. The chamber 22*a*, in turn, is connected with the suction tube 12 through a control line 23. The reduced pressure chamber 22*a* contains a diaphragm spring 24 acting against the membrane 20. The spring 24 holds the valve 1 closed during atmospheric pressure or at only slightly reduced pressure. The other side of the membrane 20 is loaded by atmospheric pressure which exists in a chamber 22*b* (second chamber) defined by the membrane 20 and the lower membrane housing 21*b*. The atmospheric air is communicated to the chamber 22*b* through a bore 25. The bore 25 is in turn formed by aligned holes through a supporting flange portion 29*a* of the cover tube 29 and through the lower membrane housing 21*b*. To seal the housing 21 in assembly with the flange portion 29*a*, a plastic seal 31 is provided. A valve rod 26 connects the membrane 20 with a movable valve member 27 which cooperates with a valve seat 28 formed by an inwardly turned flange portion 29*b* of the cover tube 29. The movable valve member 27 is generally cup shaped at one end and moves in the cover tube 29. The valve body 30 defines a bore 30*a* with which one end of the tube 29 is received. The tube 29 rests against a shoulder 30*b* formed by the valve body 30 at the bottom of the bore 30*a*. Threadedly engaged to the upper end of the rod 26 is a mounting bushing 36 to which a lower plate 38 and an upper spring retaining plate 40 are mounted. The center portion of the membrane 20 is retained between the plates 38 and 40. In addition, the bushing 36 also provides for mounting the center portion of the seal 31**.

The valve 13 in the suction tube 12 is circumvented by a bypass line 33 of the suction tube 12, so that, when the flap valve 13 is closed, the air quantity necessary for idling operation must flow through this bypass. The idling operation air quantity and hence also the idling operation rpm is set by an arbitrarily adjustable throttle 34 within the bypass 33. The bypass line 33 traverses the cover tube 29 of the exhaust gas recycling valve 1 and thereby effects a cooling of the chamber 42, defined by the movable valve 27, the cover tube 29, and the sealing element 31. Nevertheless, the surfaces of the movable valve 27 and of the seat 28, which are exposed to the exhaust gas flowing through the line 16, can be at temperatures that prevent a deposition of exhaust gas components in the closure region of the valve.

In order to cause a different pressure to prevail in the reduced pressure chamber **22*a*, in dependence on the load conditions mentioned above, the control line 23 terminates in the suction tube 12 upstream of the throttle flap 13 but in the immediate vicinity of the throttle flap member 35 of the flap valve 13 which moves in opposition to the air stream. As a result, approximately atmospheric pressure prevails in the reduced pressure chamber 22*a* as long as the throttle flap 13 is closed so that the valve 1 is closed. As the throttle flap valve 13 increasingly opens, the vacuum in this partial-load region increases in dependence on the rpm and this opens valve 1 relatively rapidly. When the throttle flap valve 13** has assumed the horizontal position corresponding to a full-load condition, the reduced pressure is again less because a stronger influence prevails from the suction tube inlet side. This reduced pressure is not sufficiently high to keep the valve open so that it closes again. In this way, the above-cited desired control of the exhaust gas recycling is achieved.

That which is claimed is:

1. In a control installation for internal combustion engines having exhaust gas recycling, the engine including:

a. suction tube;

b. an arbitrarily settable throttle flap valve mounted within the suction tube, the throttle flap valve setting being dependent on the load condition of the engine; and c. an exhaust gas pipe; the installation including:

d. an exhaust gas recycling valve whose setting is dependent on the pressure in the suction tube; and e. a return line leading from the exhaust gas pipe to the recycling valve and from the recycling valve to the suction tube, the return line being connected to the suction tube downstream of the throttle flap valve, the improvement in the installation comprising a bypass line which extends from the suction tube upstream of the throttle flap valve to the recycling valve and back to the suction tube downstream of the throttle flap valve, with the air passing through the bypass line serving as an engine supply during engine idling and to cool the recycling valve; and f. a control line having a first end thereof connected to the recycling valve and another end connected to the suction tube upstream of and proximate to the throttle flap valve so that the pressures prevailing in the immediate region of the throttle flap valve are communicated to the recycling valve.

2. The control installation as defined in claim 1, wherein the recycling valve includes:

a. a membrane housing;

b. a membrane mounted in said membrane housing, the membrane and housing defining first and second chambers into which suction tube pressure and atmospheric pressure are communicated, respectively;

c. a movable valve member having a generally cup-shaped end;

d. a valve rod connected at one end to the membrane and at the other end to the movable valve member;
e. a valve body; and
f. a cover tube connected at one end to the membrane housing and at the other end to the valve body, wherein the movable valve member is displaceable within the cover tube and wherein the bypass line is connected to the cover tube so that the air quantity carried by the bypass line passes through that portion of the cover tube between the membrane housing and the movable valve member.

3. The control installation as defined in claim 2, further including an adjustable throttle valve disposed within the bypass line, the adjustable throttle valve controlling the idling operation air quantity in the bypass line.

* * * * *